United States Patent [19]

Adlon et al.

[11] Patent Number: 4,835,858

[45] Date of Patent: Jun. 6, 1989

[54] METHOD AND APPARATUS FOR ASSEMBLING ELECTRICAL HARNESSES

[75] Inventors: Daniel T. Adlon, Harrisburg; William C. Arbogast, Jr., Mechanicsburg, both of Pa.

[73] Assignee: AMP Incorporated, Harrisburg, Pa.

[21] Appl. No.: 173,505

[22] Filed: Mar. 25, 1988

[51] Int. Cl.[4] ..... H01R 43/00

[52] U.S. Cl. ..... 29/868; 29/857; 29/748; 29/755

[58] Field of Search ..... 29/747–749, 29/751, 857, 861, 863, 868, 755

[56] References Cited

U.S. PATENT DOCUMENTS 3,859,724 1/1975 Folkenroth .
4,043,017 8/1977 Folk et al. .
4,428,114 1/1984 Teagno .
4,549,343 10/1985 Grubb .

*Primary Examiner*—Mark Rosenbaum
*Assistant Examiner*—Taylor J. Ross
*Attorney, Agent, or Firm*—James M. Trygg; Frederick W. Raring

[57] ABSTRACT

An electrical harness comprising a plurality of harness subassemblies is assembled by locating the subassembly leading ends of all of the subassemblies in a staging zone. The subassemblies are moved in succession along a transporting path which extends away from the staging zone in a succession which locates the subassembly leading ends of the several subassemblies at the required locations along the length of the harness. Bindings for the conductors in the harness subassemblies are applied where required. A fully automatic apparatus is disclosed for carrying out the process comprising individual transporters for each of the harness subassemblies which move the subassemblies individually along the transporting path.

20 Claims, 12 Drawing Sheets

7
16
$S_4$
$S_3$
$S_2$
10
$S_1$

7
$S_2$
$S_1$ 7
14
$S_2$
$S_1$ 7
16
$S_4$
14
$S_3$
14
$S_2$
10
$S_1$

METHOD AND APPARATUS FOR ASSEMBLING ELECTRICAL HARNESSES

FIELD OF THE INVENTION

This invention relates to method and apparatus for assembling electrical harnesses of the type comprising a plurality of harness subassemblies.

BACKGROUND OF THE INVENTION

A conventional electrical harness comprises a plurality of harness subassemblies, each subassembly in turn comprising a plurality of generally parallel electrical conductors which are held together at one location along the length of the subassembly. It is common practice to produce harnesses of the type under consideration by first manufacturing the subassemblies required for the harness and then assembling the subassemblies to each other on a harness board. The subassemblies required are positioned on the harness board by a technician, each subassembly being located in a position corresponding to the position it will occupy in the completed harness. The harness board will ordinarily have some means for temporarily holding the subassemblies in their proper position while the technician places all of the required subassemblies on the board and then binds them together by means of bundle ties or tape.

The assembling method described above requires careful attention on the part of the technician, particularly if the subassemblies are similar to each other as regards length and number of conductors. Furthermore, the process can be time consuming, particularly if one or more of the subassemblies is relatively long. The bundle ties or other binding means must be placed on the harness at precisely the correct locations and this requirement further increases the possibility of error and the production of defective harnesses.

The present invention is directed to a method of assembling electrical harnesses which avoids the disadvantages of conventional harness board assembly methods and which can be carried out with a relatively simple apparatus. The invention is further directed to the achievement of a harness assembling apparatus which is compatible with the use of a robot and which can be integrated with other machines, such as a lead making machine, an insertion machine for inserting the terminals on electrical leads into electrical connectors, and suitable conveyors, in a manner such that completed electrical harnesses can be produced at one work station from the conductors, wires, and connector housings required for the completed harness.

THE INVENTION

The invention comprises an apparatus for assembling a harness which in turn comprises first and second harness subassemblies. Each of the subassemblies comprises a group of conductors which are generally parallel to each other and which are held together as a group at one location. The harness has a harness leading end and a harness trailing end and each harness subassembly has a subassembly leading end and a subassembly trailing end. The subassembly leading end of the first subassembly is at the harness leading end and the subassembly leading end of the second subassembly is between the harness leading end and the harness trailing end. The groups of conductors in the first and second subassemblies are bound into a single bundle at a binding location which is between the subassembly leading end of the second subassembly and the harness trailing end. The apparatus comprises a staging zone having staging fixture means therein for holding the subassembly leading ends of the first and second subassemblies with the conductors extending from the staging zone in a first direction. First and second subassembly transporters are provided which are initially positioned proximate to the staging zone and which are independently movable from the staging zone along a transporting path which extends away from the staging zone in a second direction. Each of the transporters has subassembly holding means for releasably holding its respective harness subassembly during movement along the transporting path. Actuating and control means are provided for moving the first transporter along the transporting path a distance equal to the distance between the harness leading end and the subassembly leading end of the second subassembly and for thereafter moving the first and second transporters in unison a further distance along the transporting path a distance sufficient to move the completed harness onto the transporting path; in other words, to move the harness until the harness trailing end has been moved past the staging zone. Binding means are provided on the transporting path at a location proximate to the staging zone for binding the conductors into a bundle, the actuating and control means having means for actuating the binding means.

In accordance with a further embodiment, the apparatus is capable of assembling a harness comprising a succession of more than two subassemblies. The apparatus has a number of transporters which is equal to the number of subassemblies in the harness and the actuating and control means has means for successively moving each of the transporters in unison with previously moved transporters a distance equal to the distance between the subassembly leading end of the subassembly being moved and the next subassembly in the succession. The actuating and control means has means for moving the transporter associated with the last subassembly in the succession a distance equal to the distance between the subassembly leading end of the last subassembly in the succession and the trailing end of the harness.

In accordance with the method aspect of the invention, and where the completed harness comprises two subassemblies, the completed harness is assembled by positioning the subassembly leading ends of the first and second subassemblies in a staging zone with the conductors extending from the staging zone in a first direction. Thereafter, the first subassembly is moved axially, leading end first, away from the staging zone along a transporting path which extends from the staging zone in a second direction. The first subassembly is moved a distance equal to the distance between the harness leading end and the subassembly leading end of the second subassembly in the completed harness. Thereafter, the first and second subassemblies are moved in unison a further distance along the transporting path and the groups of conductors in the first and second subassemblies are bound into a bundle. The completed harness can then be removed from the transporting path.

Where the completed harness comprises a series of subassemblies (three or more subassemblies) the subassemblies can be designated as $S_1$, $S_2$, $S_3$, ***$S_n$. The leading ends of all of the subassemblies are placed in the staging zone, as explained above, with the conductors extending from the staging zone in a first direction. The first subassembly, $S_1$, is first moved along the transporting path a distance equal to the distance between the first and second subassemblies in the completed harness. Thereafter, the first and second subassemblies are moved along the transporting path a distance equal to the distance between the second and third subassemblies, $S_2$ and $S_3$. The moving step is repeated for the subassemblies remaining in the staging zone until all of the subassemblies have been moved therefrom and the trailing end of the harness has been moved past the staging zone. The moving process is interrupted as required and bindings are applied to the conductors which have been moved past the staging zone.

THE DRAWING FIGURES

FIG. 8 is a frontal view of an apparatus in accordance with the invention.

Figure 9:
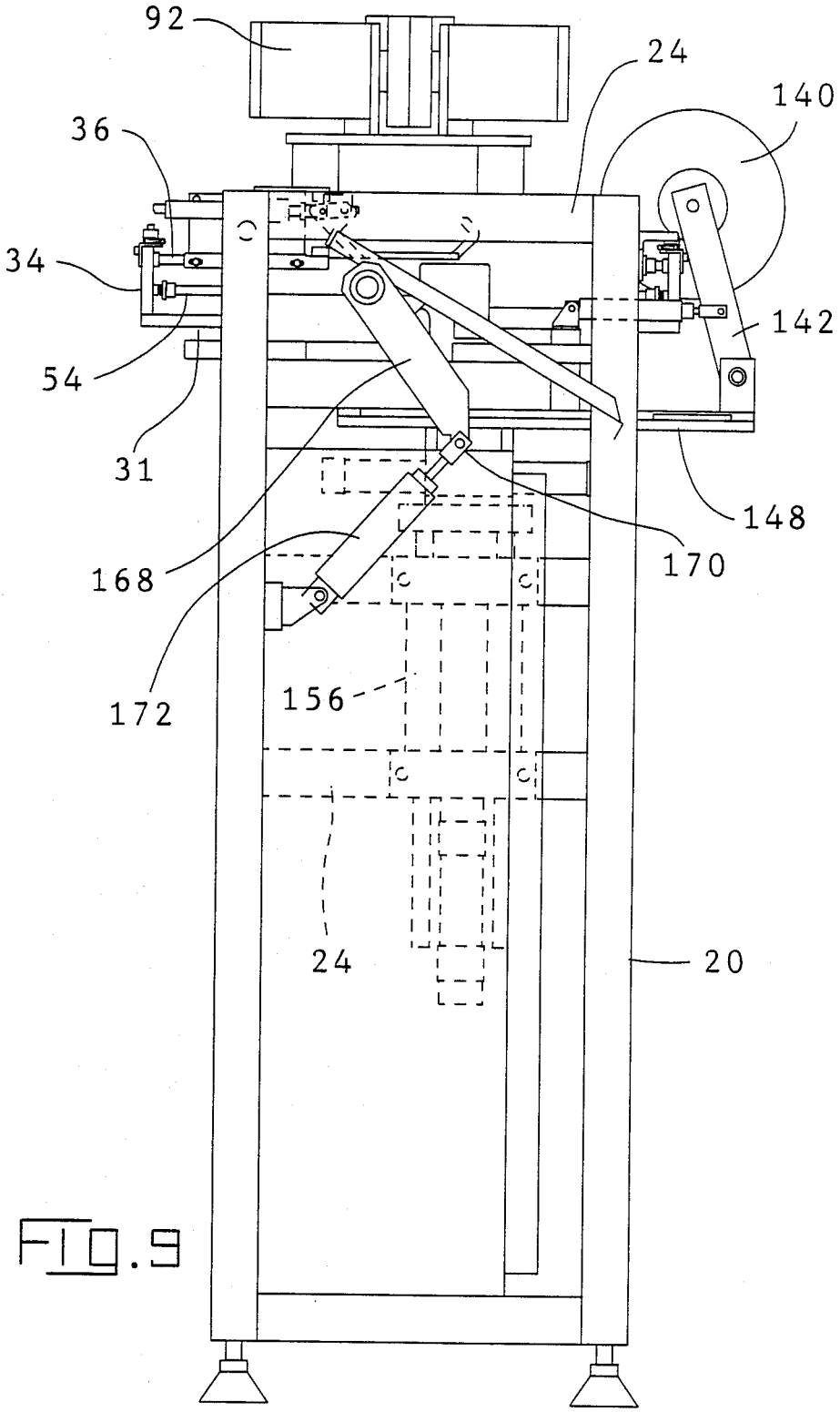
Figure 10:
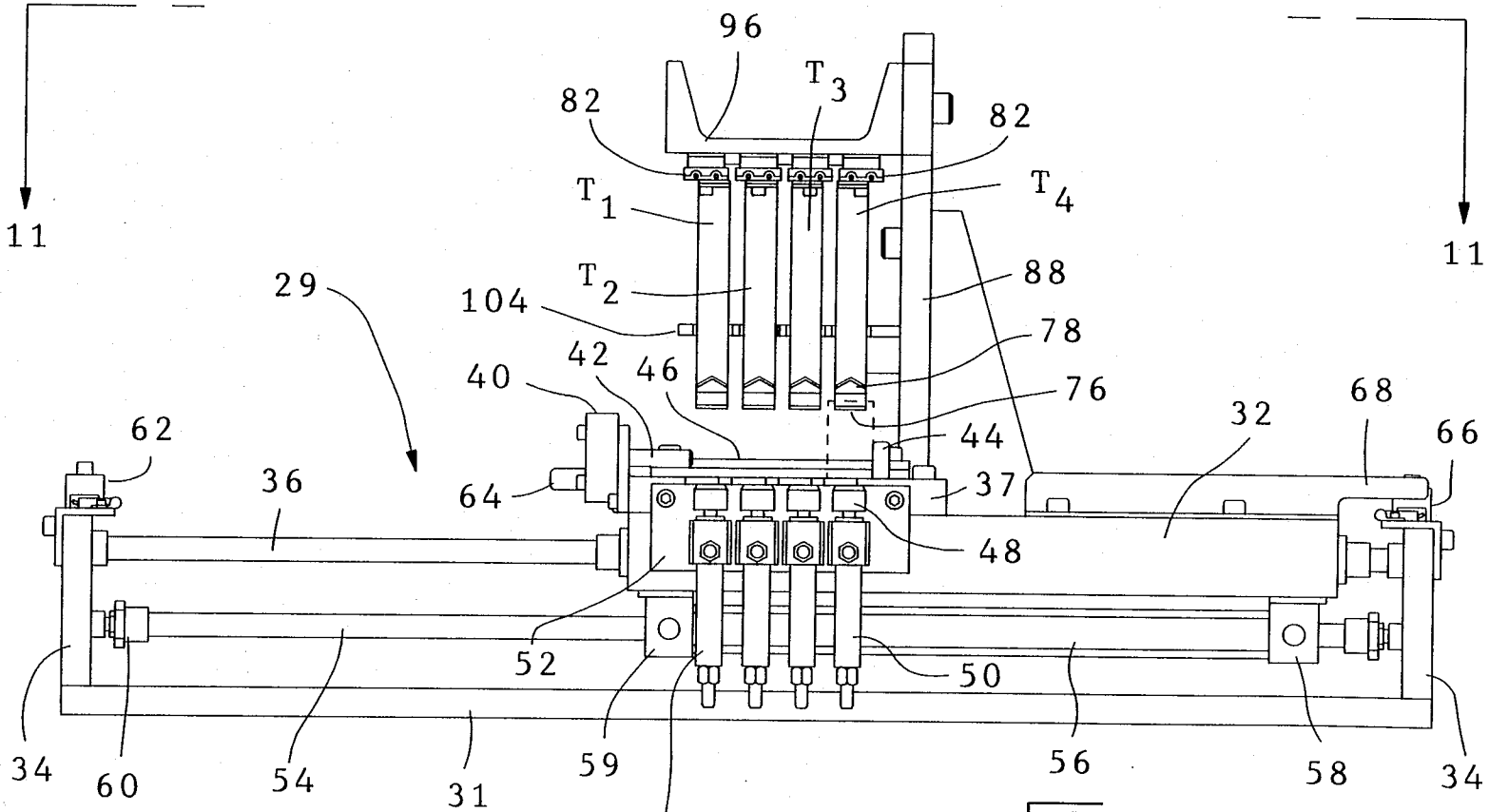

FIGS. 9 and 10 are views looking in the direction of the arrows 9—9 and 10—10 of FIG. 8.

Figure 11:
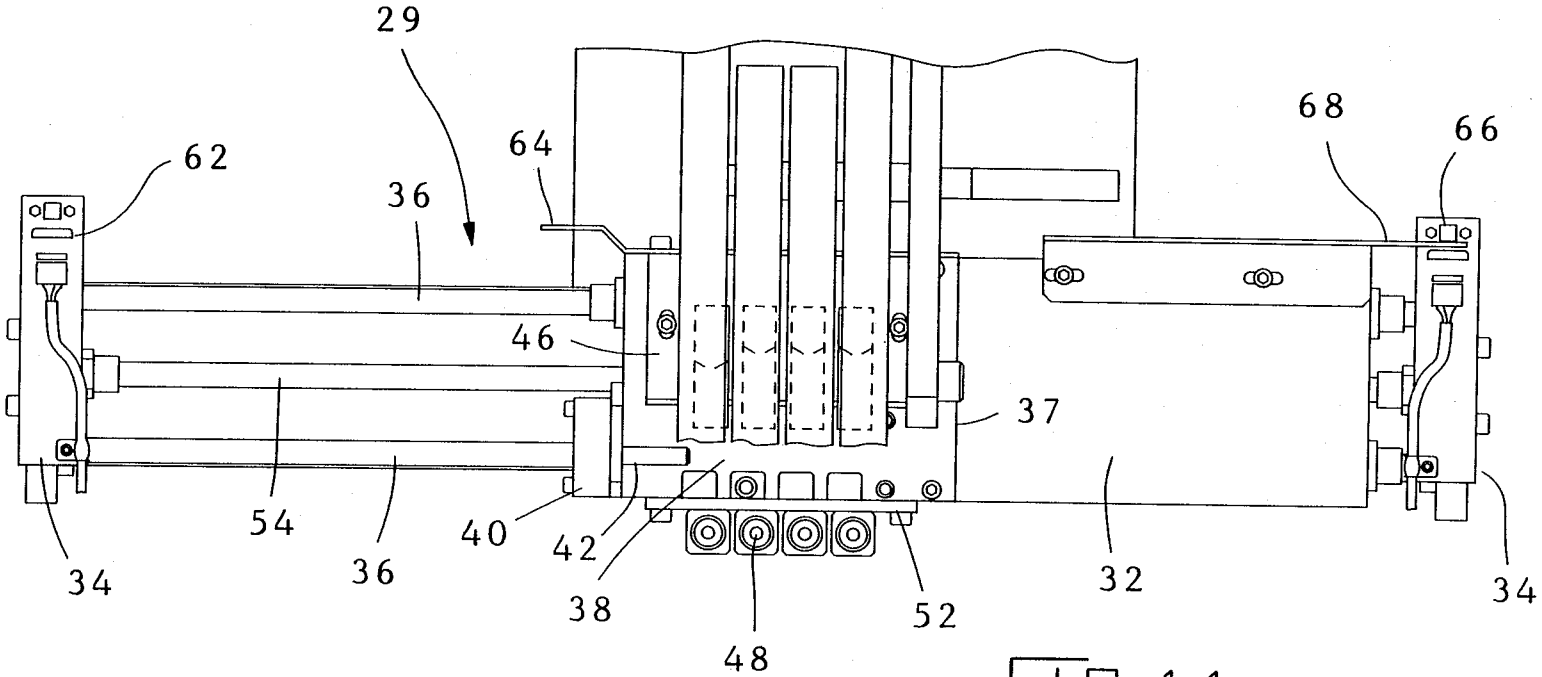

FIG. 11 is a view looking in the direction of the arrows 11—11 of FIG. 10.

Figure 12:
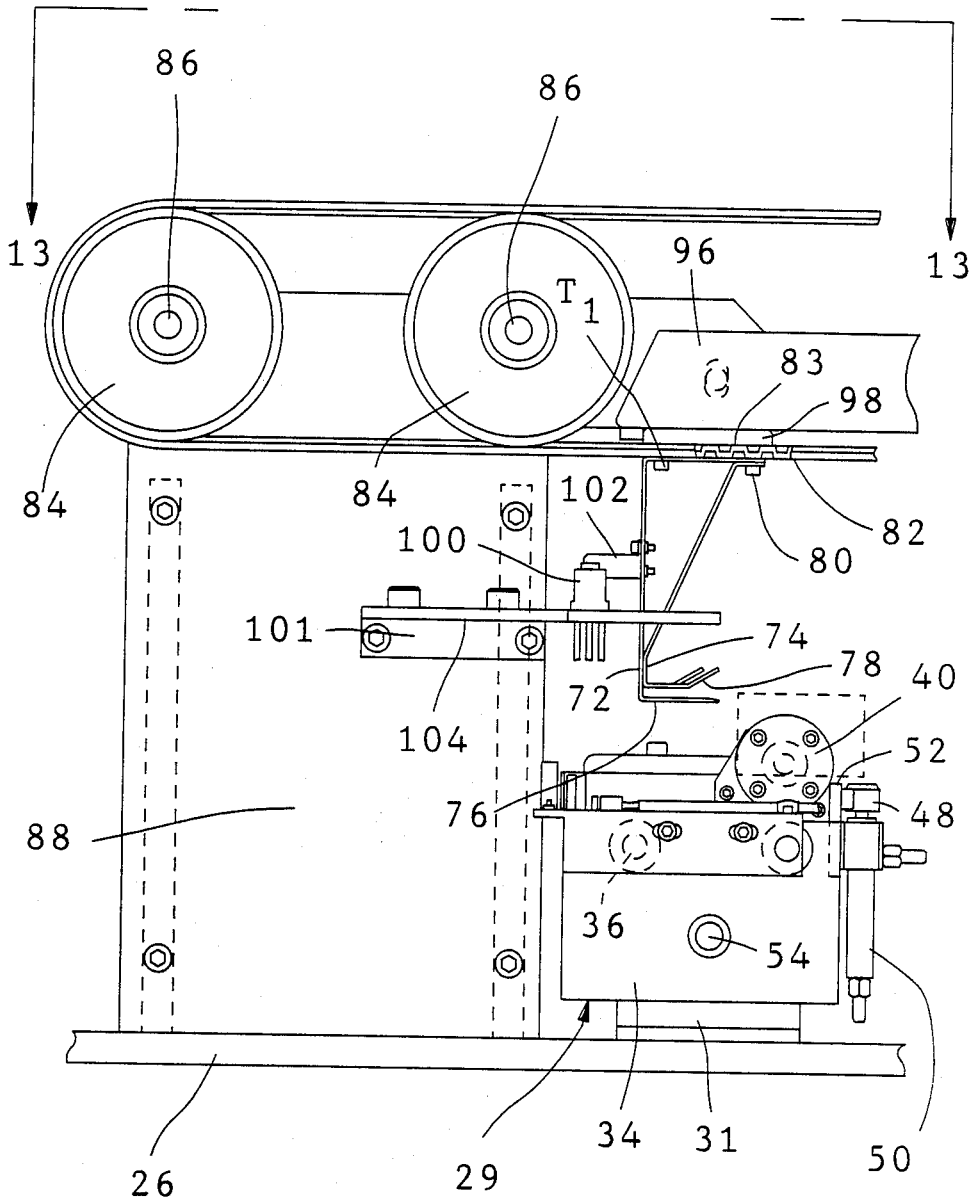

FIG. 12 is a view, on an enlarged scale, of the upper left-hand portion of the apparatus as it appears in FIG. 8 showing details of the transporters and the manner in which they are secured to the endless belts.

Figure 13:
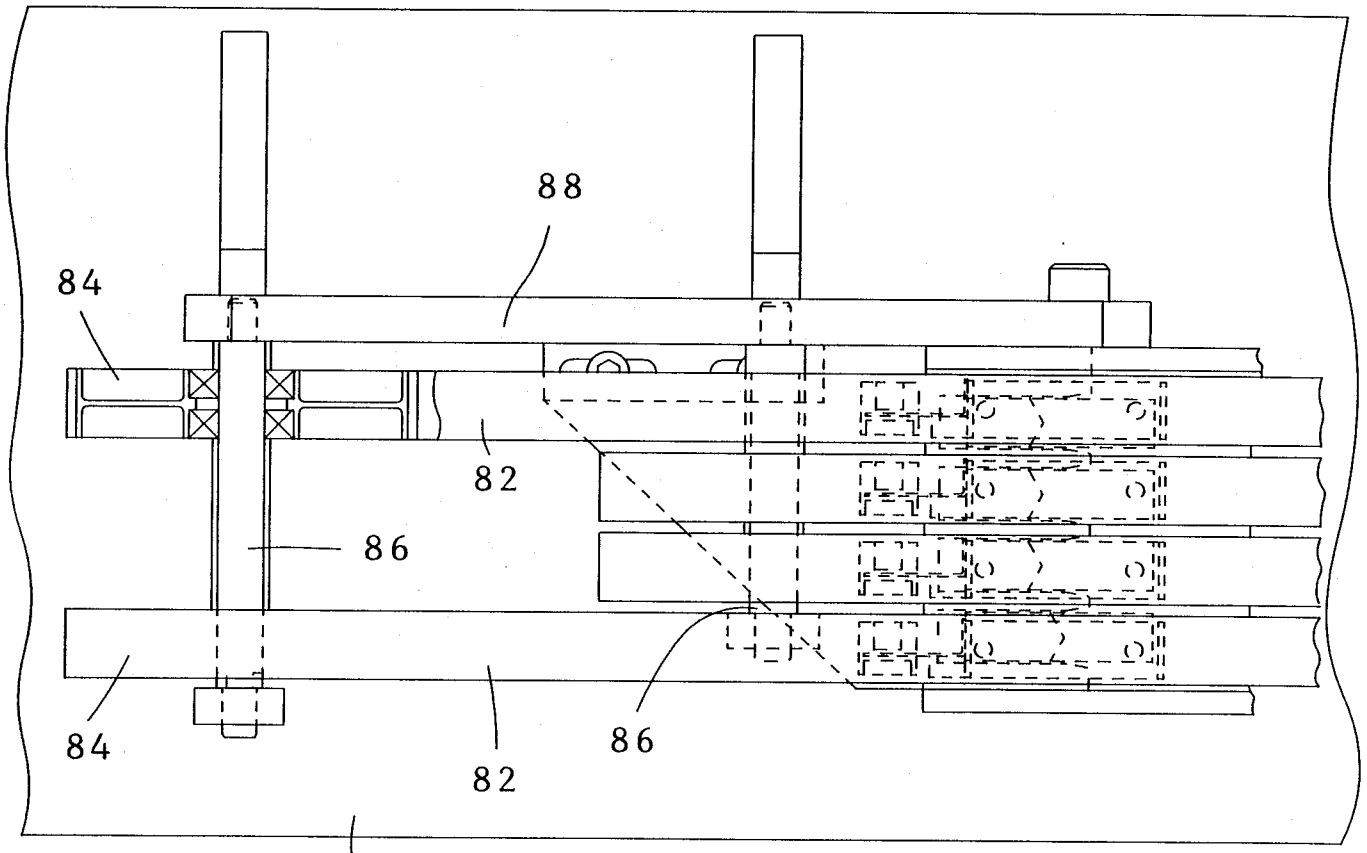

FIG. 13 is a view looking in the direction of the arrows 13—13 of FIG. 12.

Figure 14:
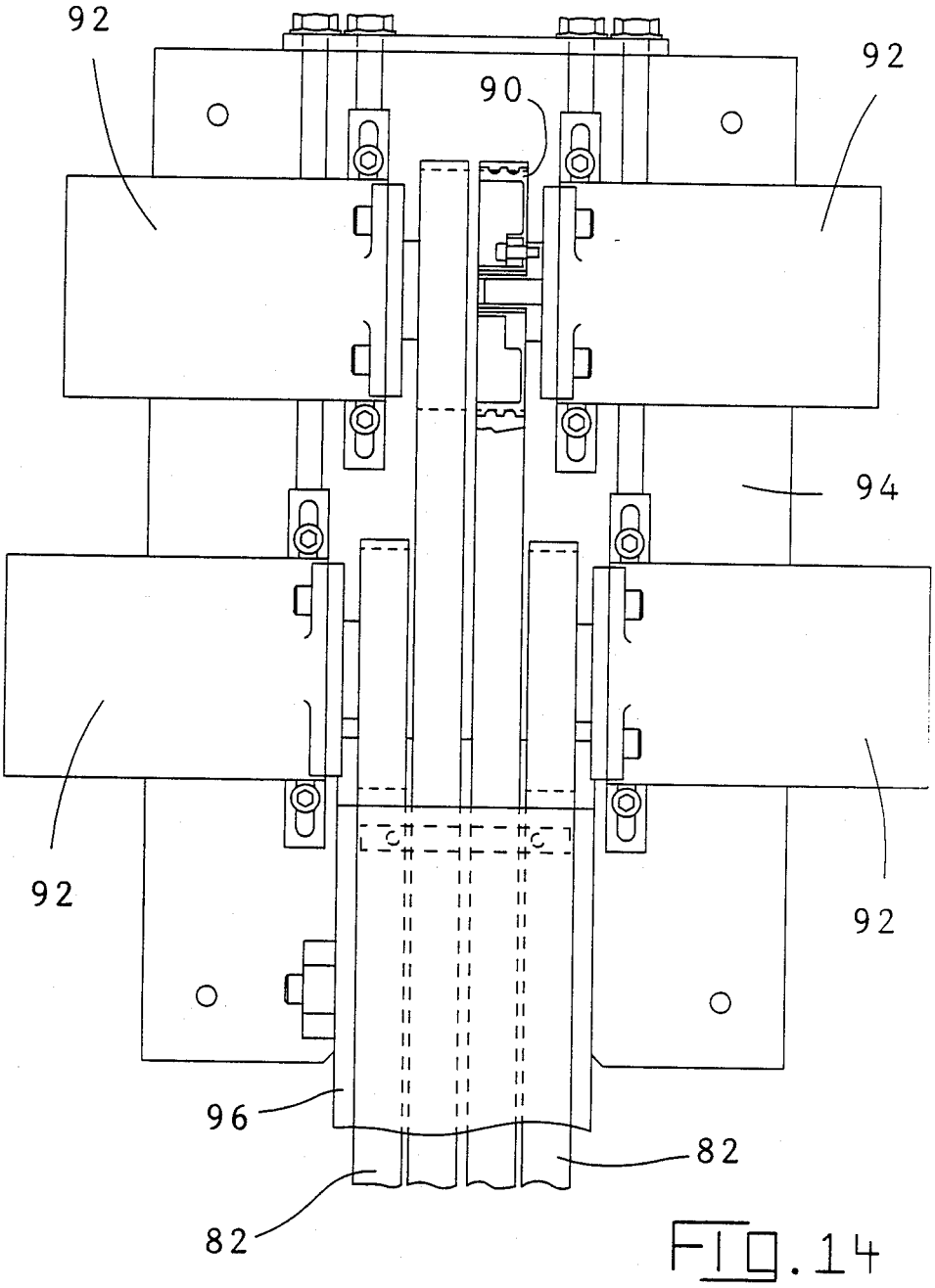

FIG. 14 is a view, partially in section, looking in the direction of the arrows 14—14 of FIG. 8.

Figure 15:
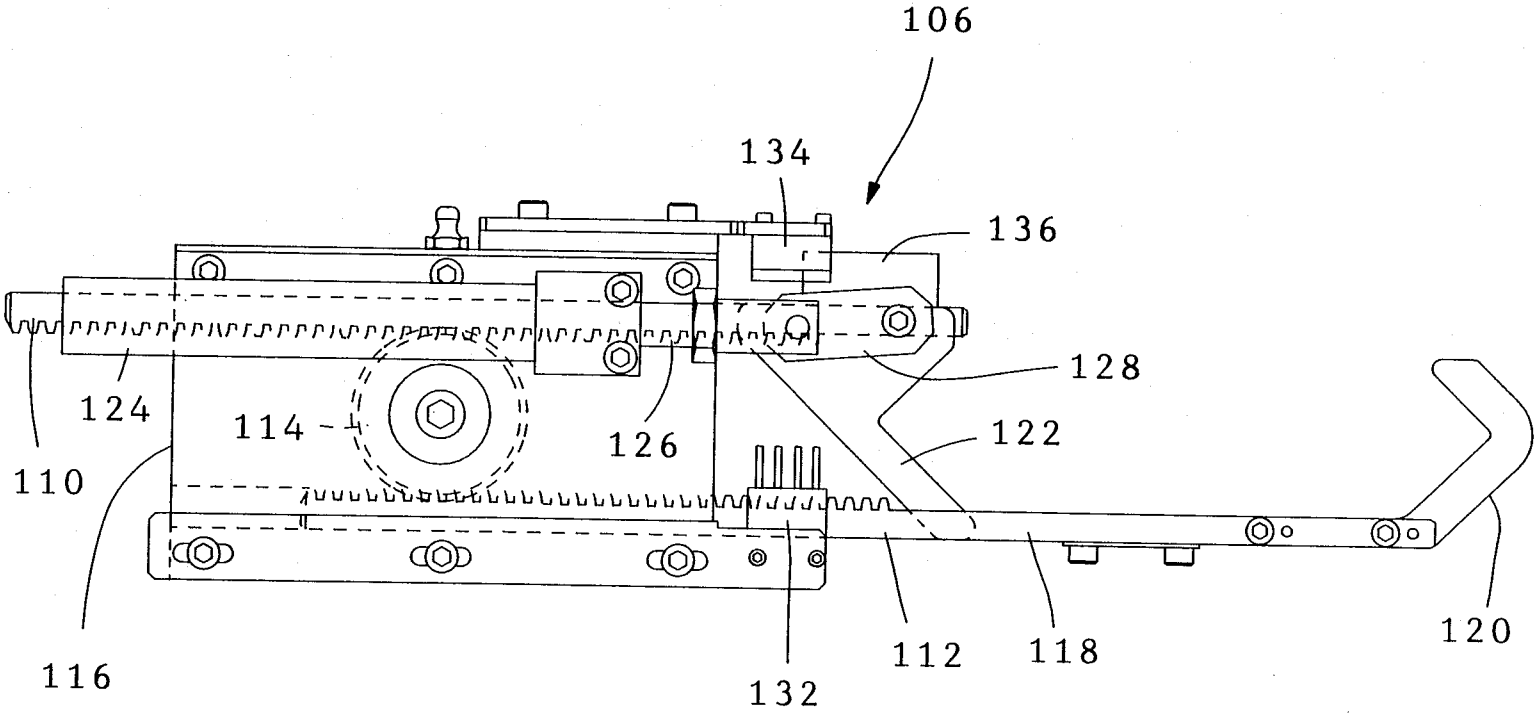

FIG. 15 is a side view of the wire gatherer.

Figure 16:
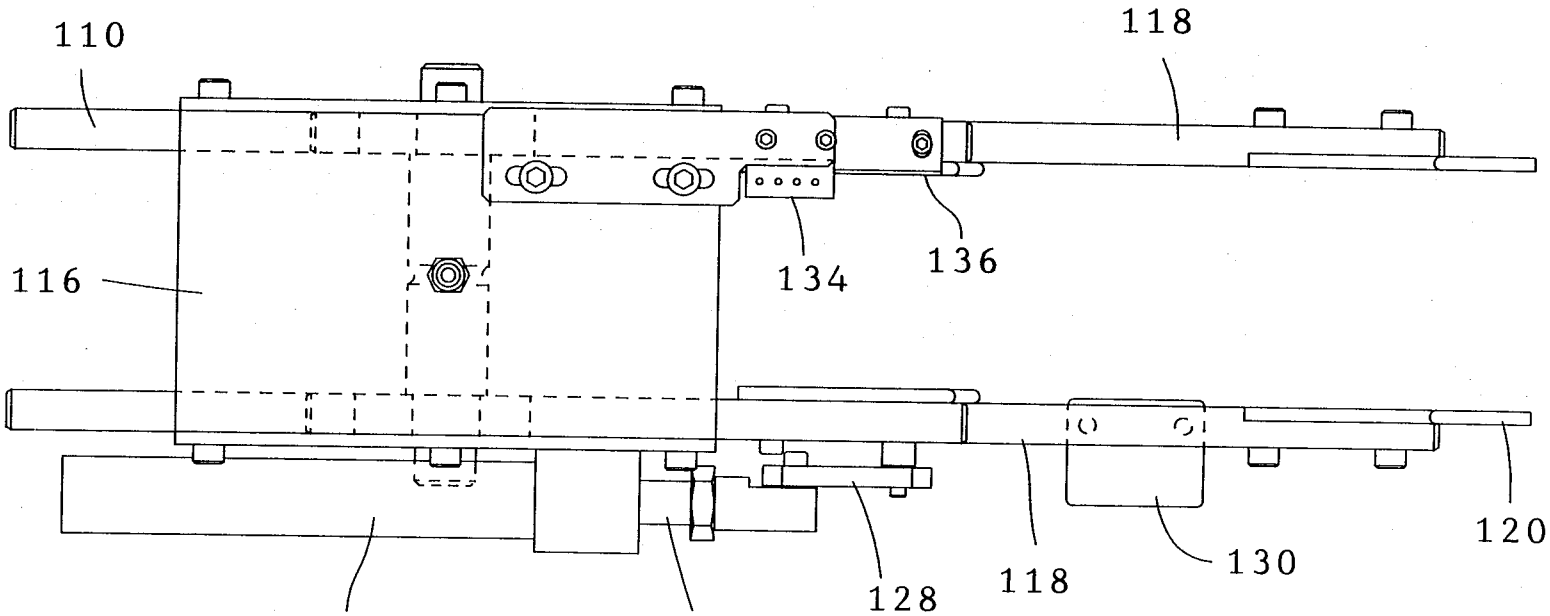

FIG. 16 is a view looking in the direction of the arrows 16—16 of FIG. 15.

Figure 17:
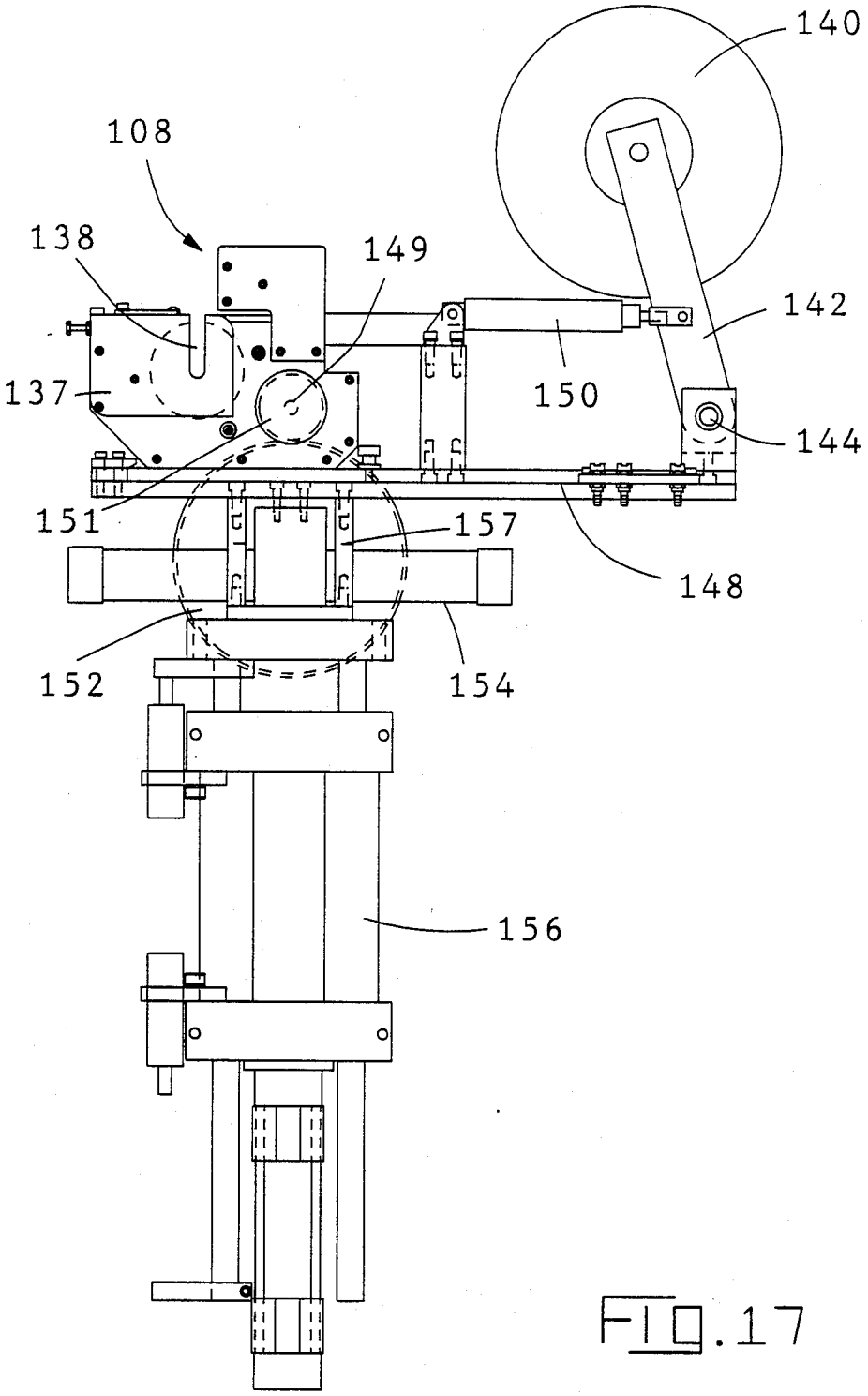

FIGS. 17 is a view showing the wire taping device which applies tape to wires bundled by the gathering device of FIG. 15.

FIG. 18 is a perspective view of a connector housing.

THE DISCLOSED EMBODIMENT

A typical harness 2 of the type which can be produced by the method and apparatus of the invention is made up of a plurality of harness subassemblies S which are individually designated as $S_1$, $S_2$, $S_3$, and $S_4$. Each subassembly has a subassembly leading end 4 and a subassembly trailing end 6. The conductors 7 of each subassembly are crimped onto terminals which are contained in an electrical connector 8 which is at the subassembly leading end 4. The completed harness 2 has a harness leading end 10, and a harness trailing end 12. The subassembly leading end of subassembly $S_1$ is at the leading end of the harness and the subassembly leading ends of the remaining subassemblies are at locations between the harness leading end 10 and the harness trailing end 12. Bindings 14 are provided along the length of the harness as required. A binding will always be required between the leading end of the last subassembly in the harness, $S_4$, and the trailing end of the harness. Other bindings may be provided between the subassembly leading ends of all of the subassemblies as shown.

The connector 8, FIG. 18, has a mating face 9, a rear face 11, oppositely facing endwalls 13, upper and lower sidewalls 15, and two terminal receiving cavities 17 which extend inwardly from the rear face 11. As will be explained below, the transporters which carry the connectors along the transporting path hold the connectors by means of fingers which grip each connector on the external and internal surfaces of the upper connector sidewall 15.

Figures 4, 5, 6, 7:
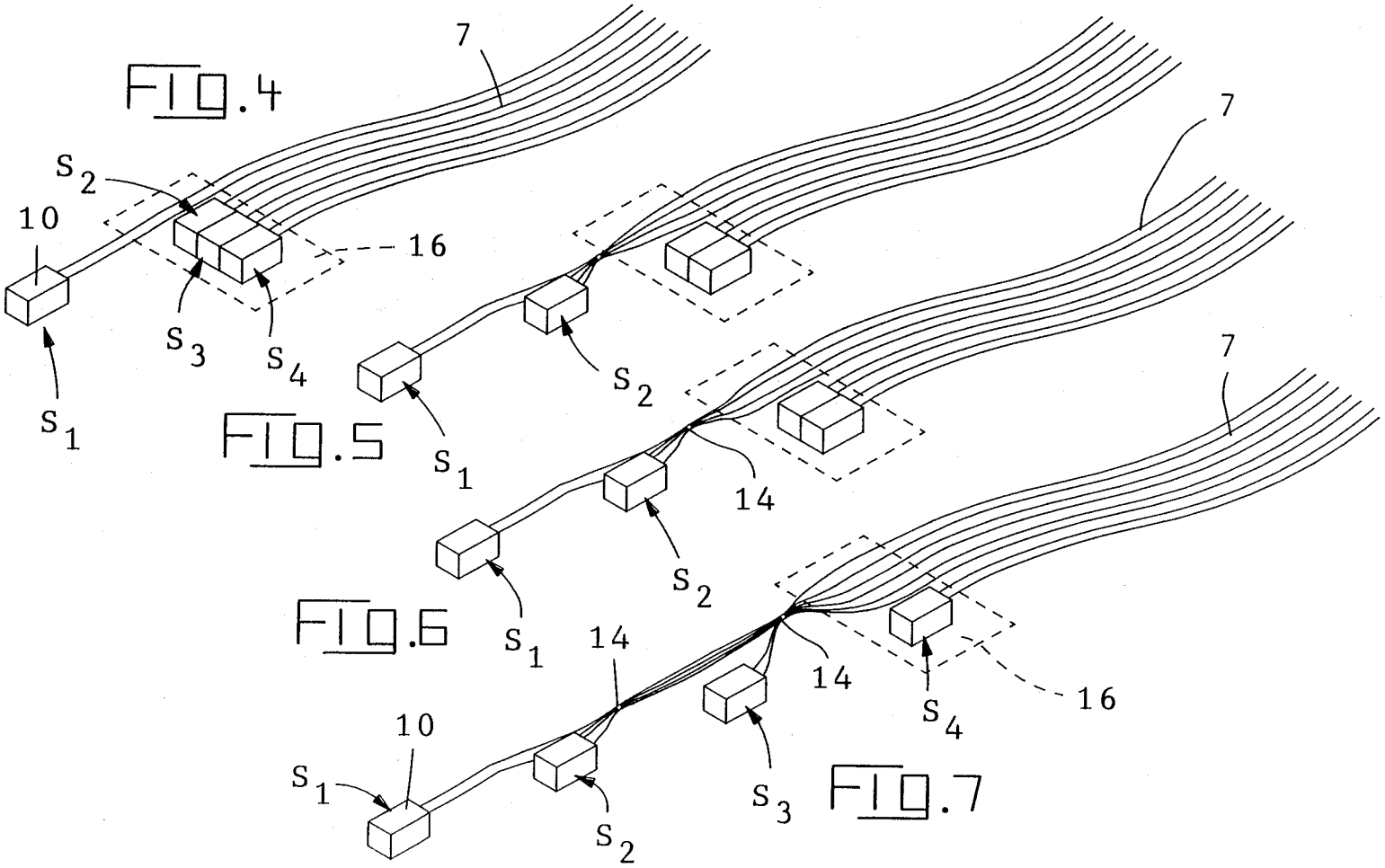
Figure 3:
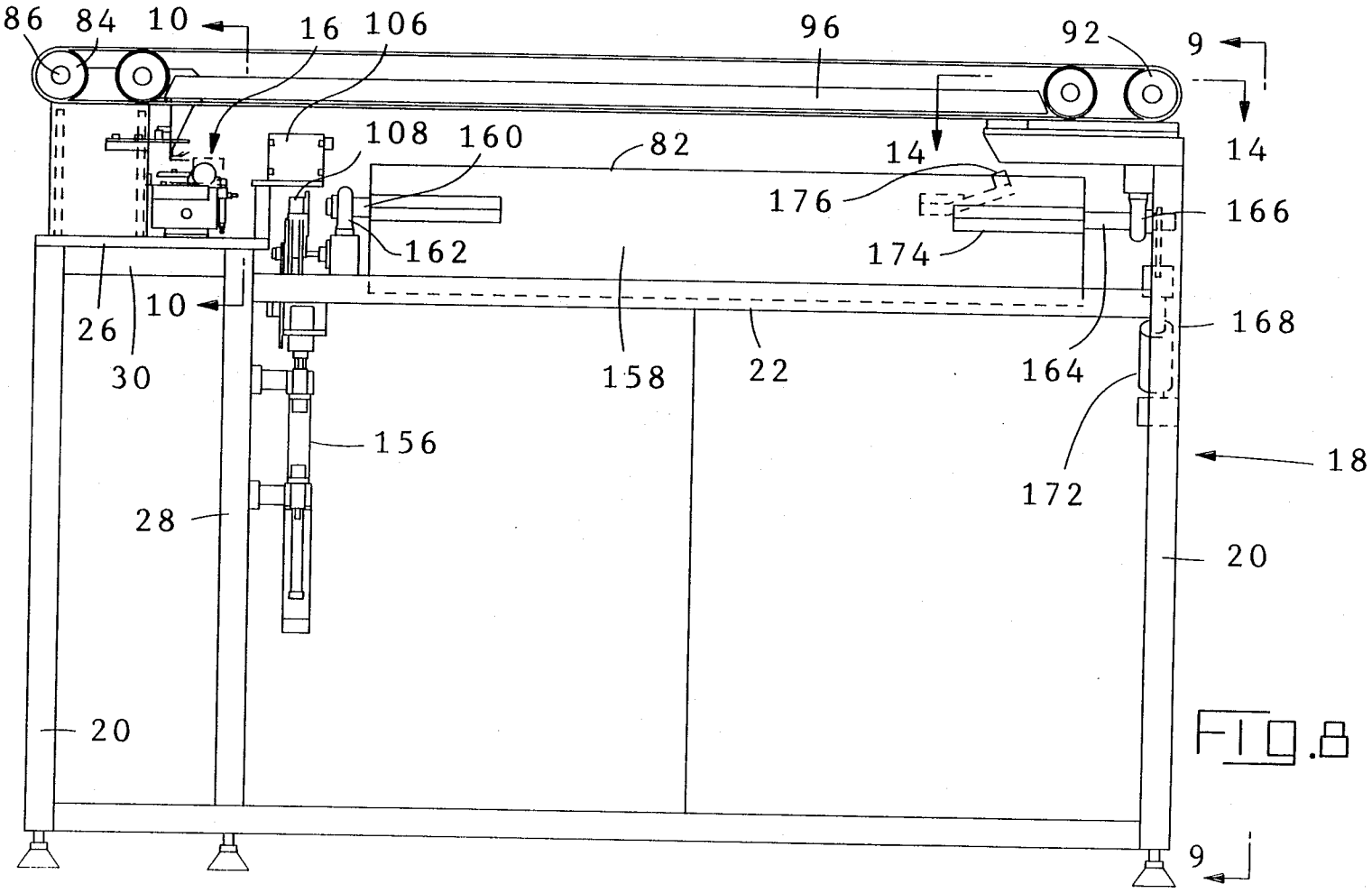

The essence of the invention is illustrated in FIGS. 3–7. The subassembly leading ends of all of the subassemblies $S_1$–$S_4$ are positioned in side-by-side relationship in a staging zone 16 with the conductors of the subassemblies extending from the staging zone in a first direction. Subassembly $S_1$ is initially moved along a transporting path, which extends from the staging zone in a second direction, by a distance equal to the distance between the leading ends of the $S_1$ and $S_2$ in the finished harness. Thereafter, $S_1$ and $S_2$ are moved a short distance so that the conductors adjacent to the subassembly leading end of $S_2$ extend beyond the staging zone 16. A binding is then applied as shown in FIG. 5 to bind the conductors of subassemblies $S_1$ and $S_2$. Subassemblies $S_1$ and $S_2$ are then moved a further distance along the transporting path until $S_2$ is spaced from the staging zone by a distance equal to the distance between the subassembly leading ends of $S_2$ and $S_3$ in the finished harness. Thereafter, $S_1$, $S_2$, and $S_3$ are moved in unison a short distance and a binding is applied as before to bind all of the conductors in subassemblies $S_1$, $S_2$, and $S_3$. The previously described steps are then repeated and an additional binding is applied. Finally, $S_1$, $S_2$, $S_3$, and $S_4$ are all moved in unison and the final binding is applied to the harness. The finished harness is then moved a further distance along the transporting path until the trailing end of the harness has moved beyond the staging zone at which time the finished harness can be removed.

FIGS. 8–18 show one form of apparatus for use in the practice of the invention. The apparatus 18 comprises a generally open frame having vertical support members 20, longitudinal horizontal supports 22 and transverse frame members 24. Additional vertical and horizontal supporting members 28, 30 are provided at the left-hand end of the apparatus to support the added mass of the transfer mechanism, the gathering device, and the taping mechanism as described below. A horizontal platform 26 is mounted on the frame as shown in FIG. 12 and directly supports the transfer mechanism which will now be described.

The transfer slide assembly 29, FIGS. 10–12 serves to transfer stack of four connectors having conductors extending therefrom from a loading zone to the staging zone 16. The transfer slide assembly comprises a slide block 32 which is slidable on horizontal guide bars 36 which extend between vertical support plates 34 which in turn are secured to a horizontal base plate 31 which is supported on platform 26. The slide block 32 has an adaptor block 37 mounted thereon and the upper surface 38 of this adaptor block is the support surface for the leading ends of the subassemblies which will be assembled into the finished harness. The connectors 8 on the subassembly leading ends are stacked on the surface 38 and positioned against fixed stops 44 by means of a pneumatic clamp 40 having a piston rod 42 extending therefrom. This piston rod pushes the stack of connector housings rightwardly as viewed in FIG. 10 so that they are precisely positioned and held on surface 36 prior to their movement along the transporting path as will be described below. An additional locating block 46 is mounted on the upper surface of the adapter block 37 and bears against the rearward ends of the connector housings.

Individual gates 48 are mounted on a mounting plate 52 which is secured to the rightwardly facing side (as viewed in FIG. 12) of the side block to restrain the individual housings against movement until the appropriate time in the operating cycle. These gates 48 comprise enlarged heads on the ends of piston rods extending from cylinders 50 and can be lowered individually to permit movement of the subassemblies from the staging zone in sequence.

The slide block 32 is shown in FIG. 10 in the position it occupies when the subassemblies are in alignment with the transporting path. The slide block is movable leftwardly from the position of FIG. 10 to a loading position in which the individual subassemblies are loaded onto the upper surface 38 of the adapter block 37. The actuator for moving the slide block between its two positions comprises a fixed piston rod 54 which extends between the vertical plates 34 and a movable cylinder 56 having cylinder heads 58, 59. The slide block is secured to these cylinder heads so that it will move with the cylinder between its two positions. The fixed piston on the piston rod 54 is within the cylinder and is located approximately midway between the two plates 34 so that if the slide block is to be moved from the position of FIG. 10 leftwardly, compressed air is exhausted from the cylinder at the end 58 and introduced into the cylinder at the end 59. Rightward movement of the cylinder and the slide block is brought about by exhausting the end 59 of the cylinder and introducing compressed air at the end 58. Adjustable stops 60 are provided on the ends of the piston rod 54 so that the precise location of the slide block can be determined when it is in either of its two positions.

Sensors 62, 66 are provided on the vertical plates 34 for determining the position of the slide block assembly. These sensors detect the presence of sheet metal vanes 64, 68 which are mounted on the adapter block 37 and on the right-hand end of the slide block as shown in FIG. 11. These sensors are required for the actuating and control system for the apparatus.

The four harness subassemblies are moved along the transporting path by individual transporters $T_1$, $T_2$, $T_3$, and $T_4$, FIG. 10. Each transporter, as shown in FIG. 12, comprises a generally triangular sheet metal frame having its base 71 secured to an endless belt 82 by a fastener 80. The legs of the triangular frame of each transporter have lower ends 72, 74 which are secured to each other and which have spaced apart fingers 76, 78 which extend in the direction of movement of the harness subassemblies along the transporting path. The free end of the upper leg 78 is flexed upwardly as shown so that when the-transporters move against a connector positioned in the staging zone, the lower leg 76 will enter the terminal receiving cavity of the connector housing and the upper leg will move over the external surface of the housing. The connector housing will thus be releasably held between these two fingers 76, 78.

Each endless belt 82 has internal teeth 83 and each belt extends around an idler sprocket 84, which is adjacent to the staging zone, and a driven sprocket 90 which is located beyond the end of the transporting path as shown in FIGS. 8 and 14. The idler sprockets 84 are mounted for free rotation on fixed spaced apart shafts 86 which extend, cantilever fashion, from a bracket 88 which is secured to, and extends upwardly from, the platform 26 The sprockets for the belts which carry transporters $T_1$ and $T_4$ are spaced apart and carried by the left-hand shaft in FIG. 13 while the sprockets for transporters $T_2$ and $T_3$ are carried by the right-hand shaft.

Each of the driven sprockets 90 is secured to the stub shaft of a stepping motor 92. The stepping motors are supported in staggered relationship on a platform 94 with the stepping motors for transporters $T_2$ and $T_3$ offset with respect to the sprockets for transporters $T_1$ and $T_4$. It will be apparent from FIG. 14 that this arrangement permits all four stepping motors to be mounted closely adjacent to each other. Each of the stepping motors is capable of moving its associated endless belt, and the transporter carried by the belt, in either direction by precisely determined distances.

The transporters are stabilized and guided during movement along the transporting path by belt support plates 98, FIG. 12, which are secured to the belts and which bear against the downwardly facing surface of a channel-shaped belt guide 96. The guide extends from the staging zone to the platform 91 on which the stepping motors are mounted as shown in FIG. 8.

A sensor 100 is provided for each of the transporters and is mounted on a support plate 104 which is secured by means of an adapter block 101 to the vertically extending bracket 88. Each sensor 100 detects the presence of a sheet metal vane 102 secured to the vertical arm of the transporter frame when the transporter is in the staging zone.

The bindings are applied to the harness subassemblies in a taping zone, FIGS. 15–17 which is immediately adjacent to the staging zone. The taping zone contains a wire gathering unit 106 and a wire taping unit 108. The gathering unit is supported in a fixed position on the apparatus frame structure and comprises two upper racks 110 and two lower racks 112 which are contained in a housing 116. A spur gear 114 is mounted for free rotation on a shaft extending between the upper and lower pairs of racks so that movement of any one of the racks will cause the others to move. The lower racks 112 have arms 118 extending therefrom which have crooked gathering fingers 120 on their ends. The upper racks 110 have downwardly extending sheet metal fingers 122, the ends of which bear against the arms 118. It will be apparent from FIG. 15 that relative movement of the fingers 122 towards the crooked fingers 120 will cause gathering of the wires which are located between the opposed edges of these fingers. The gathering unit is actuated by a pneumatic piston cylinder 124 having a piston rod 126 which is coupled by a link 128 to one of the fingers 122. When the cylinder is pressurized to cause rightward movement of the piston rod, the associated rack is moved rightwardly and the spur gear 114 causes the other racks to move so that the fingers 120, 122 approach each other. These fingers are normally spaced apart by a distance sufficient to accommodate all of the wires of all of the harness subassemblies and to permit movement of the leading ends of the subassemblies there past during the operation of the apparatus.

A sensor 134 is provided on the housing 116 and detects the presence of a vane 136 on the adjacent finger 122 when the gatherer is in its open position. A sensor 132 is also provided on the housing and detects the presence of a vane 130 which is on one of the lower arms 118. Again, these sensors are required for the actuating and control system for the apparatus in order to prevent the commencement of any step of the process until the steps previously required in the sequence have been completed.

The taping unit 108 is of a commercially available type and need not be described in detail. The unit shown is a Cee-Kay Model 200S Pneumatic Tape Wrap Machine manufactured by Cee-Kay Industries, 7930 South Chicago Avenue, Chicago, Ill. 60617. The taping unit comprises a housing 137 having a slot 138 into which the conductors are inserted. Thereafter, the unit is actuated by a gear 152, described below, and a length of tape is wrapped around the conductors in the slot. Units of the type shown are not capable of pulling the tape from the spool 140, but rather require that the tape which is drawn into the unit be slack. A modified spool support is provided comprising an arm 142 which is pivoted at its lower end 144 on a base plate 148. The arm 142 is swung rightwardly in a clockwise direction from the position shown by the piston rod of a cylinder 150 which is also supported on the base plate 148. The movement of the arm 142 draws a short section of slack tape from the spool which can then be pulled into the taping unit and applied to the wires.

The mechanism in the housing 137 which applies the tape to the conductors has a shaft 149 on which there is mounted-a gear 151. The gear 151 is in meshed with a gear 152 which is on the output shaft of a commercially available indexing device 154 which rotates the gear 152 thereby to actuate the taping unit. The indexing device shown in a Rotomation model X2 Indexer manufactured by Rotomation Inc., 525 Carswell Avenue Unit M, Daytona Beach, Fla. 32017.

The taping head is normally located below the wire gatherer 106 in order to permit the leading ends of the harness subassemblies to be moved along the transporting path and between the fingers of the gathering unit. The taping head is raised by a commonly available slide unit 156 whenever a section of tape is to be applied to the conductor. The taping unit is supported above the upper end of the slide unit 156 by spacers 157 shown in FIG. 17. The particular slide unit shown which raises the taping head is a PHD Power Slide Model RS062X5-6 manufactured by PD, Inc. of Fort Wayne, Ind.

A harness receiving and support tray 158 is mounted on the apparatus frame immediately beneath the transporting path so that the subassemblies will be supported as they are pulled from the staging zone. When the last subassembly $S_4$ has been transported the requisite distance along the transporting path, the leading connector on the first harness subassembly $S_1$ moves past a resilient arm 174 which is welded or other secured to the surface of tray 158. As the connector on harness subassembly $S_1$ moves past arm 174, the arm is flexed downwardly to permit passage of the connector and the arm thereafter returns to its normal position. The arm has a stop 176 on its free end so that when the leading connector on subassembly $S_1$ is thereafter moved in a reverse direction along the transporting path, that is back toward the staging zone, the stop will prevent movement of the connector while the transporter continues its movement leftwardly towards the staging zone. The fingers on the transporter will thereby release the connector and it will fall onto the surface of the tray 158.

Figures 1, 1B, 2, 3:
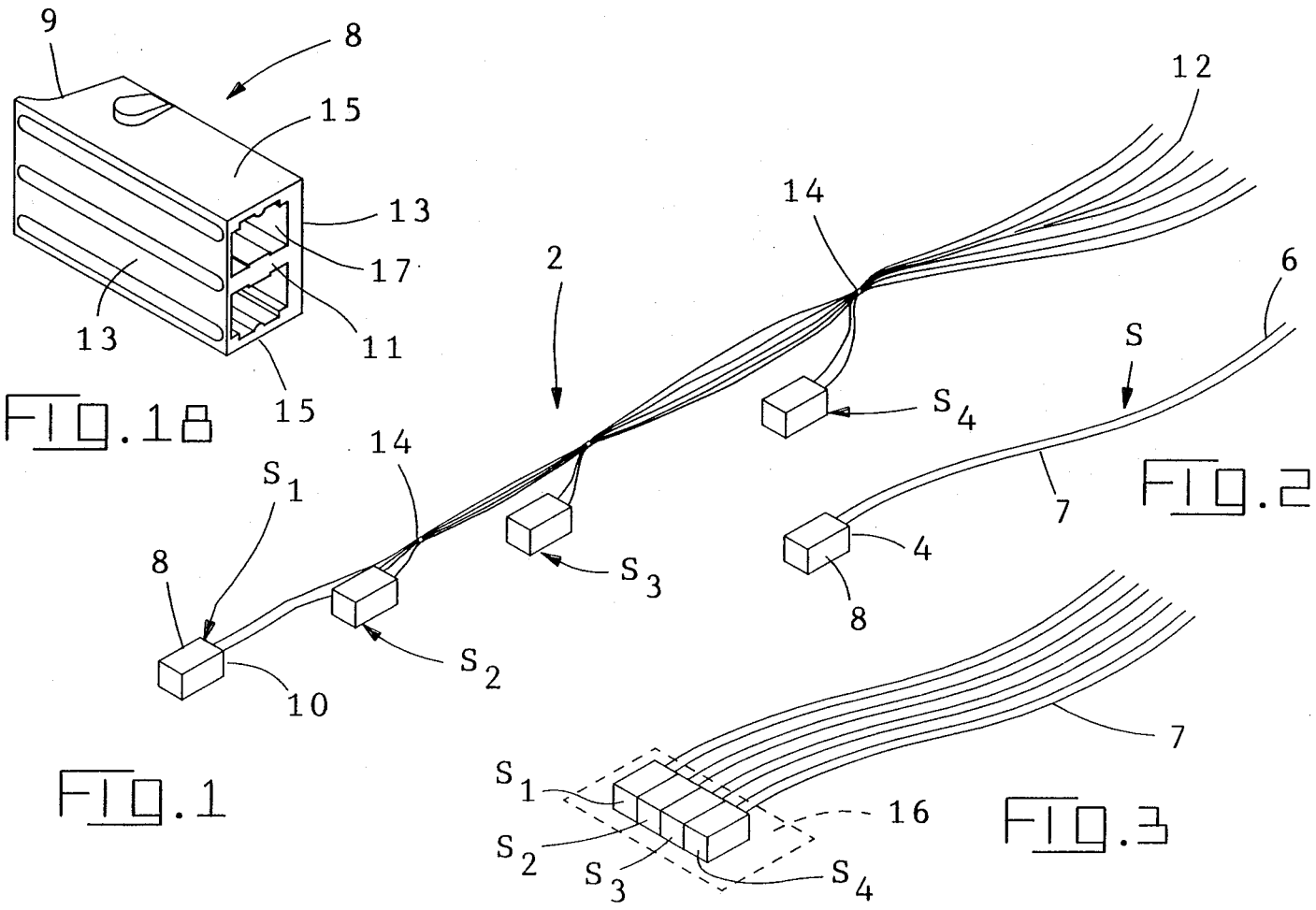
FIG. 1 is a diagrammatic view of a harness of the type which can be produced by the method and apparatus of the invention.
FIG. 2 is a diagrammatic view of a subassembly of the harness.
FIGS. 3–7 are diagrammatic views which illustrate the method of the invention.

It is necessary to provide only a single arm 174 and stop 176 for a harness of the type shown in FIG. 1 for the reason that all of the subassemblies are bound together between each two adjacent connectors. Therefore, if movement of the first connector on the first subassembly is prevented in a leftward direction as viewed in FIG. 8, movement of the other connectors is prevented and all of the transporters will release their associated connectors and the harness will be released by the transporters.

The tray 158 is supported by shafts 160 and 164 at its ends so that it can be tilted and cause the completed harness to fall therefrom into a bin or the like placed beneath the tray. The shaft 160 is secured to the underside of the tray and is supported for free rotation in a pillow block bearing 162 on the apparatus frame. The right-hand shaft 164 extends through a pillow block bearing 166 and has a crank arm 168 secured to its end. The end of the arm 168 in turn is pivotally connected at 170 to the piston rod extending from a piston cylinder 172. When it is desired to tilt the tray 168 and cause a completed harness to fall downwardly, it is merely necessary to pressurize the cylinder causing rotation of the shaft 164.

The apparatus is controlled by a suitable microprocessor or computer which is responsive to the sensors which have been described and which are associated with the elements of the apparatus. For example, the transfer slide is moved to its loading position after the last subassembly of the series has been transported from the staging zone and subassemblies for the next operating cycle can then be placed in the staging zone. The endless belts upon which the transporters are mounted are under the control of the stepping motors and are moved along the lower courses of the belts as viewed in FIG. 8. The belts are moved rightwardly during the transportation of the subassemblies along the transporting path and leftwardly after the completed harness has been released and dropped onto the tray 158. The arrival of the transporters in the staging zone is detected by the sensors on the transporters described above so that the steps of transporting the subassemblies will not commence until the transporters are in their starting positions. Similarly, sensors on the gatherer and on the taping unit prevent any of the process steps from being carried out until all previous steps have been completed.

It will be apparent from the foregoing description that a harness of the type shown in FIG. 1 can be assembled with no manual operations required. Harnesses of many different types can also be assembled by the method and apparatus of the invention. For example, the harness of FIG. 1 does not have any intermediate subassemblies which have trailing ends that are in front of the subassemblies leading end of the last subassembly in the harness. A harness having subassemblies between the leading end of the harness and the trailing end of the harness can, however, be produced. Obviously, it is necessary to bind the intermediate subassemblies so that they will be held to the longer subassemblies in the harness. The invention can be practiced with connectors other than the particular connector shown and can be practiced with harness subassemblies which have individual terminals, rather than connectors, on the subassembly leading ends. The transporters must be designed to grip the leading end of the particular subassembly being used and may take a form other than that shown.

The method of the invention can be carried out with apparatus which does not have all of the units described above. For example, the gathering and taping steps could be performed by a technician rather than by the gathering unit and the taping unit described. The method can in fact be carried out by hand rather than by an apparatus and would avoid the need for a conventional harness board.

We claim:

1. Apparatus for assembling a harness, the harness comprising first and second harness subassemblies, each of the subassemblies comprising a group of conductors which are generally parallel to each other and which are held together as a group at one location, the harness having a harness leading end and a harness trailing end, each harness subassembly having a subassembly leading end and a subassembly trailing end, the subassembly leading end of the first subassembly being at the harness leading end, the subassembly leading end of the second subassembly being between the harness leading end and the harness trailing end, the groups of conductors in the first and second subassemblies being bound into a single bundle at least one binding location which is between the subassembly leading end of the second subassembly and the harness trailing end, the apparatus comprising:

a staging zone having staging fixture means therein for holding the subassembly leading ends of the first and second subassemblies with the conductors extending from the staging zone in a first direction, first and second subassembly transporters for the first and second subassemblies respectively, the transporters being initially positioned proximate to the staging zone and being independently movable from the staging zone along a transporting path, the transporting path extending away from the staging zone in a second direction, each of the transporters having subassembly holding means for releasably holding its respective harness subassembly during movement along the transporting path, and actuating and control means for moving the first transporter along the transporting path a distance equal to the distance between the harness leading end and the subassembly leading end of the second subassembly, and thereafter moving the first and second transporters in unison along the transporting path a distance sufficient to move the completed harness onto the transporting path.

2. Apparatus as set forth in claim 1 characterized in that binding means are provided on the transporting path at a location proximate to the staging zone for binding conductors into a bundle, the actuating and control means having means for actuating the binding means.

3. Apparatus as set forth in claim 1 characterized in that the apparatus is capable of assembling a harness having a third harness subassembly, the apparatus having a third transporter for the third subassembly, the actuating and control means having means for moving the first and second transporters in unison a distance equal to the distance between the second subassembly leading end and the third subassembly leading end, and for thereafter moving the first, second, and third transporters in unison a distance equal to the distance between the third subassembly leading end and the trailing end of the harness.

4. Apparatus as set forth in claim 1 characterized in that the apparatus is capable of assembling a harness comprising a succession of more than two subassemblies, the apparatus having a number of transporters which is equal to the number of subassemblies in the harness, the actuating and control means having means for successively moving each of the transporters in unison with previously moved transporters a distance equal to the distance between the subassembly leading end of the subassembly being moved and the next subassembly in the succession, and for moving the transporter for the last subassembly in the succession a distance equal to the distance between the subassembly leading end of the last subassembly in the succession and the trailing end of the harness.

5. Apparatus as set forth in claim 1 characterized in that at least one of the subassemblies has an electrical connector on its subassembly leading end, the connector having terminals therein, the conductors being connected to and extending from, the terminals, the conductors on the one subassembly being held together as a group by the connector, the transporter holding means for the one subassembly comprising a connector holder.

6. Apparatus as set forth in claim 1 characterized in that the apparatus has releasing means for releasing the subassemblies from their respective subassembly holding means after the assembly of the harness has been completed.

7. Apparatus for assembling a harness of the type comprising a series of harness subassemblies which are designated as $S_1$, $S_2$ ***$S_n$, each of the subassemblies comprising a group of conductors which are generally parallel to each other and which are held together as a group at one location, the harness having a harness leading end and a harness trailing end, each harness subassembly having a subassembly leading end and a subassembly trailing end, the subassembly leading end of subassembly $S_1$ being at the harness leading end, the subassembly leading ends of the successive subassemblies being at spaced-apart locations along the length of the harness between the harness leading end and the harness trailing end, the groups of conductors in the subassemblies being bound together at a location adjacent to the harness trailing end, the apparatus comprising:

a staging zone having staging fixture means therein for holding the subassembly leading ends with the conductors extending from the staging zone in a first direction, a plurality of subassembly transporters which are designated as $T_1$, $T_2$, ***$T_n$, the transporters being initially positioned proximate to the staging zone and being independently movable from the staging zone along a transporting path, the transporting path extending away from the staging zone in a second direction, each of the transporters having subassembly holding means for releasably holding a subassembly during movement, the individual transporters being engageable with the individual subassemblies of like subscript designation, binding means on the transporting path at a location proximate to the staging zone, the binding means comprising means for binding conductors into a bound bundle, and actuating and control means for moving $T_1$ along the transporting path a distance equal to the distance between the subassembly leading ends of $S_1$ and $S_2$, for thereafter moving $T_1$ and $T_2$ in unison along the transporting path a distance equal to the distance between the subassembly leading ends of $S_2$ and $S_3$, and thereafter moving each transporter in succession and in unison with the previously moved transporters a distance equal to the distance in the completed harness between the subassembly leading end of the subassembly which is being moved and the next succeeding subassembly of the series and for interrupting the movement of subassembly $S_n$ and binding the conductors by actuating the binding means.

8. Apparatus as set forth in claim 7 characterized in that the transporting path is a horizontal path.

9. Apparatus as set forth in claim 7 characterized in that the actuating and control means comprises means for interrupting the movement of any one of the subassemblies along the transporting path and actuating the binding means whereby the conductors can be bound into a bundle at any location along the length of the harness.

10. Apparatus as set forth in claim 9 characterized in that the conductors are discrete wires, the apparatus having a wire gathering means proximate to the binding means for gathering the wires into a bundle prior to actuation of the binding means.

11. Apparatus as set forth in claim 7 characterized in that at least one of the subassemblies has an electrical connector on its subassembly leading end, the connector having terminals therein, the conductors being connected to, and extending from, the terminals, the conductors of the one subassembly being held together as a group by the connector, the transporter for the one subassembly comprising a connector holder.

12. Apparatus as set forth in claim 7 characterized in that the apparatus has releasing means for releasing the subassemblies from their respective subassembly holding means after the assembly of the harness has been completed.

13. Apparatus as set forth in claim 7 characterized in that each of the subassemlies has an electrical connector on its subassembly leading end, the connectors having terminals therein, the conductors being connected to, and extending from, the terminals, the conductors of the individual subassemblies being held together as individual groups by the connectors, the transporters comprising connector holders, and harness releasing means is provided for releasing all of the subassemblies from their respective connector holders after assembly of the harness has been completed.

14. Apparatus as set forth in claim 13 characterized in that each of the connector holding means comprises a holding finger means which holds its respective connector when moving along the transporting path away from the staging zone and which is incapable of holding its respective connector when moving towards the staging zone.

15. Apparatus as set forth in claim 14 characterized in that the releasing means comprising comprises a static stop means on the transporting path which is engageable with at least one of the connectors and which prevents the one connector from moving towards the staging zone, the stop means being spaced from the staging zone by a distance which is substantially equal to the distance between the one connector and the trailing end of the harness.

16. Apparatus as set forth in claim 7 characterized in that the transporters are mounted on endless belts, the belts extending parallel to the transporting path in side by side relationship, the actuating and control means comprising means for moving the belts.

17. Apparatus as set forth in claim 16 characterized in that the actuating and control means comprises belt drive means which is capable of moving the belts individually in either direction.

18. A method of assembling a harness of the type comprising first and second subassemblies which are designated as $S_1$ and $S_2$, each of the subassemblies comprising a group of conductors which are generally parallel to each other and which are held together as a group at one location, the harness having a harness leading end and a harness trailing end, $S_1$ and $S_2$ each having a subassembly leading end and a subassembly trailing end, the subassembly leading end of $S_1$ being at the harness leading end, the subassembly leading end of $S_2$ being between the harness leading end and the harness trailing end, the groups of conductors in $S_1$ and $S_2$ being bound into a single bundle at least one location which is between the harness leading end and the harness trailing end, the method comprising the steps of:

positioning the subassembly leading ends of $S_1$ and $S_2$ in a staging zone with the conductors extending from the staging zone in a first direction, axially moving $S_1$, leading end first, away from the staging zone along a transporting path, which extends away from the staging zone in a second direction, a distance equal to the distance between the harness leading end and the subassembly leading end of $S_2$ in the completed harness, axially moving $S_1$ and $S_2$ in unison a further distance along the transporting path, binding the groups of conductors in $S_1$ and $S_2$ into a bundle, and thereafter removing the completed harness from the transporting path.

19. A method as set forth in claim 18 characterized in that the harness comprises a series of subassemblies in excess of two, the third subassembly being designated as $S_3$ and the last subassembly in the series being designated as $S_n$, the method comprising the steps of, subsequent to the movement of $S_1$ and $S_2$ along the transporting path, moving $S_1$, $S_2$, and $S_3$ in unison along the transporting path a distance equal to the distance between $S_2$ and $S_3$ in the finished harness, thereafter repeating the moving step until all of the subassemblies have been moved from the staging zone, the subassemblies moved during each moving step comprising the subassemblies which were moved in the previous moving step plus the next subassembly in the series.

20. A method as set forth in claim 19 characterized in that the last moving step, during which all of the subassemblies are moved, is interrupted and all of the conductors in the cable which are being moved are bound during the interruption.

* * * * *